US009004759B2

(12) United States Patent
Gilbert

(10) Patent No.: US 9,004,759 B2
(45) Date of Patent: Apr. 14, 2015

(54) FLORAL SLEEVE WITH HANDLE

(75) Inventor: Scott R. Gilbert, Marco Island, FL (US)

(73) Assignee: Professional Package Company, Strongsville, OH (US)

( * ) Notice: Subject to any disclaimer, the term of this patent is extended or adjusted under 35 U.S.C. 154(b) by 0 days.

(21) Appl. No.: 13/494,064

(22) Filed: Jun. 12, 2012

(65) Prior Publication Data

US 2013/0327817 A1 Dec. 12, 2013

(51) Int. Cl.

| | |
|---|---|
| ***B65D 33/06*** | (2006.01) |
| ***B65D 33/10*** | (2006.01) |
| ***B65D 30/00*** | (2006.01) |
| ***B65D 33/16*** | (2006.01) |
| ***B65D 33/02*** | (2006.01) |
| ***B31B 1/00*** | (2006.01) |
| ***B65D 85/50*** | (2006.01) |
| *B65D 30/28* | (2006.01) |

(52) U.S. Cl.

CPC ..... *B31B 1/00* (2013.01); *B31B 2219/9029* (2013.01); *B31B 2219/9035* (2013.01); *B31B 2237/10* (2013.01); *B31B 2237/25* (2013.01); *B31B 2237/406* (2013.01); *B65D 31/18* (2013.01); *B65D 33/02* (2013.01); *B65D 33/065* (2013.01); *B65D 85/505* (2013.01); *B65D 2301/10* (2013.01); *B65D 2301/20* (2013.01)

(58) Field of Classification Search

USPC ..... 383/7–9, 14, 17, 37, 62, 77, 107, 119, 383/903

See application file for complete search history.

(56) References Cited

U.S. PATENT DOCUMENTS

| | | | | |
|---|---|---|---|---|
| 3,186,626 | A * | 6/1965 | Shvetz | 383/37 |
| 3,448,915 | A * | 6/1969 | Schwarzkopf | 383/37 |
| 3,480,198 | A * | 11/1969 | Repko | 383/203 |
| 3,664,575 | A * | 5/1972 | Lake | 383/62 |
| 4,709,400 | A * | 11/1987 | Bruno | 383/77 |
| 4,715,963 | A * | 12/1987 | Jones | 210/781 |
| 5,020,184 | A * | 6/1991 | Roberts | 15/257.5 |
| 6,918,699 | B2 * | 7/2005 | Hanson | 383/8 |
| 7,798,711 | B2 * | 9/2010 | Plunkett et al. | 383/22 |
| 2009/0304307 | A1 * | 12/2009 | Diep et al. | 383/7 |

FOREIGN PATENT DOCUMENTS

| | | | | |
|---|---|---|---|---|
| FR | 1496589 | A * | 4/1967 | |
| GB | 1150037 | A * | 4/1969 | |
| WO | WO 9008071 | A1 * | 7/1990 | B65D 33/16 |

OTHER PUBLICATIONS

Machine translation of French Document No. 1.496.589. Translated on Sep. 19, 2013.*

* cited by examiner

*Primary Examiner* — Jes F Pascua

(57) ABSTRACT

A sleeve has an open top and side edges. One or more handles are defined by perforations that extend inward from the side edges and can terminate with a stress concentration-reducing shape. The handles may be tapered. The handles may include a reinforcing weld formed by an extension of the bottom seal of adjacent, oppositely oriented sleeves.

2 Claims, 6 Drawing Sheets

FLORAL SLEEVE WITH HANDLE

TECHNICAL FIELD

The present disclosure relates to sleeves for packaging floral groupings such as bouquets of flowers or other products, and to methods of making such sleeves.

BACKGROUND

Sleeves are used in the floral industry to package floral groupings for shipment between growers and retail outlets and also at retail outlets for packaging goods for sale to retail customers. Floral groupings include pot plants, bouquets and similar materials. Fresh produce and plants, e.g. spices such as basil or thyme, also can be packaged in the same way, and they are included within the meaning of the term "floral grouping". Sleeves for floral groupings come in a variety of sizes and shapes. They may be rectangular, or square, tall or short, depending on the merchandise to be packaged and the customer's choice. Often sleeves for floral groupings are tapered or frusto-conical to hold a pot plant or bouquet. The sleeves may have open bottoms or closed bottoms.

Bags with various types of handles are known, including some with handles that are formed by openings through the upper part of the sleeve and some in which separate handles are attached to the upper part of the sleeve.

SUMMARY

A sleeve is formed from two flat panels each having a top edge, a bottom edge, and two side edges. The side edges are spaced apart to define the width of the sleeve. The two panels are joined to each other along the opposite side edges to form a pair of seams. The sleeve includes a first handle defined by a line of perforations through the two panels that extends from one seam across part of the width of the two panels toward the other seam. The panels can be separable from each other across their top edges to enclose a space into which an article such as a floral grouping may be placed.

A sleeve with handles may be made by feeding layers of web material to form two superimposed layers, each layer having a top edge and a bottom edge. The layers can be sealed to each other to form first and second seams along first and second side edges. The seams can extend between the top and bottom edges of the two layers of web material. A first line of perforations can be formed spaced downward from the top edges of the first layer and the second layer and extending from the first seam to the second seam to define a header from which the sleeve is separable for use. A second line of perforations can be formed spaced downward from the first line of perforations and extending inward from the first seam toward the second seam to define a handle.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION

Figure 1:
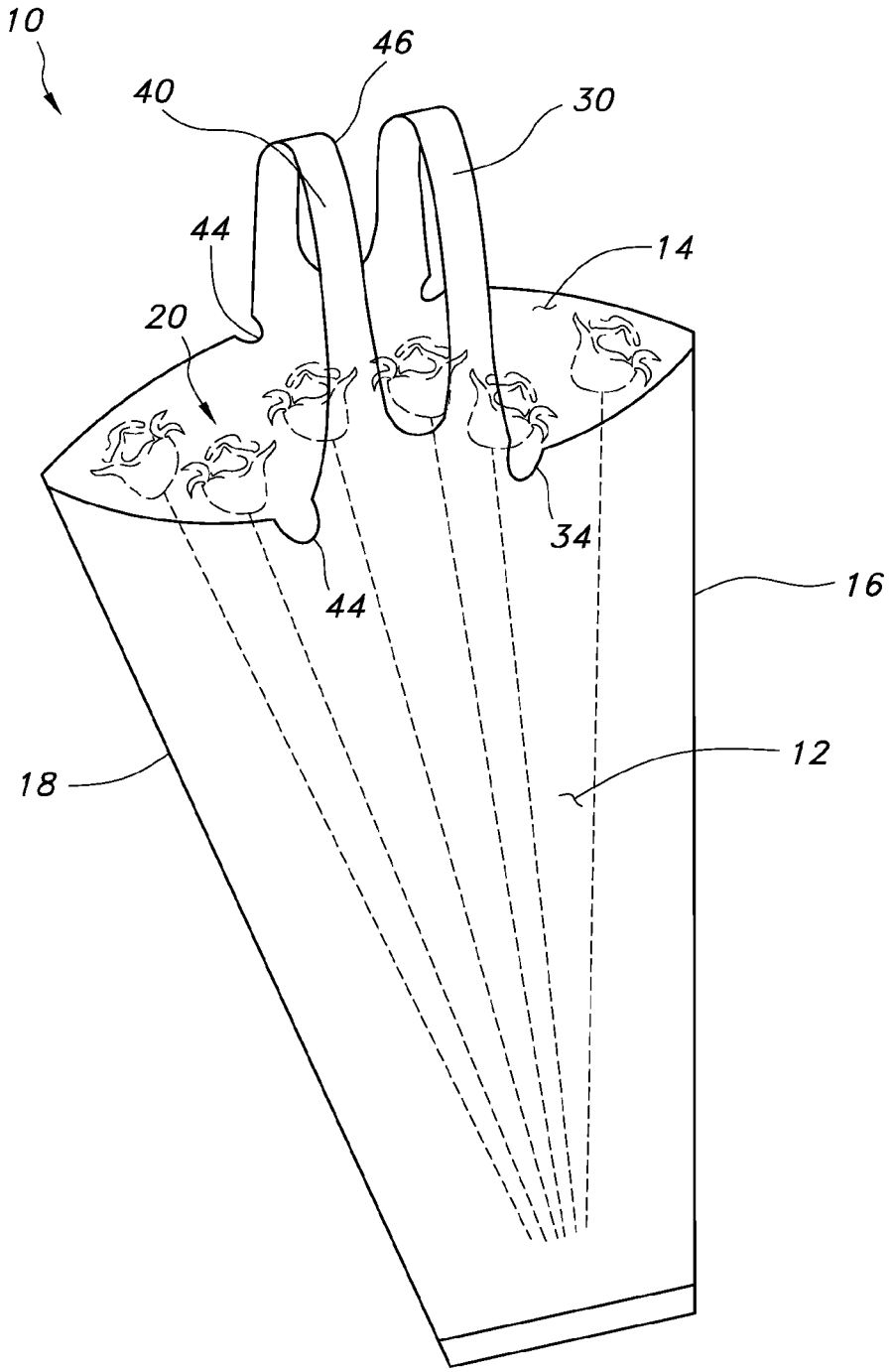
FIG. 1 is a perspective illustration of a sleeve constructed following the teachings of this disclosure, opened and ready for use.
Figure 2:
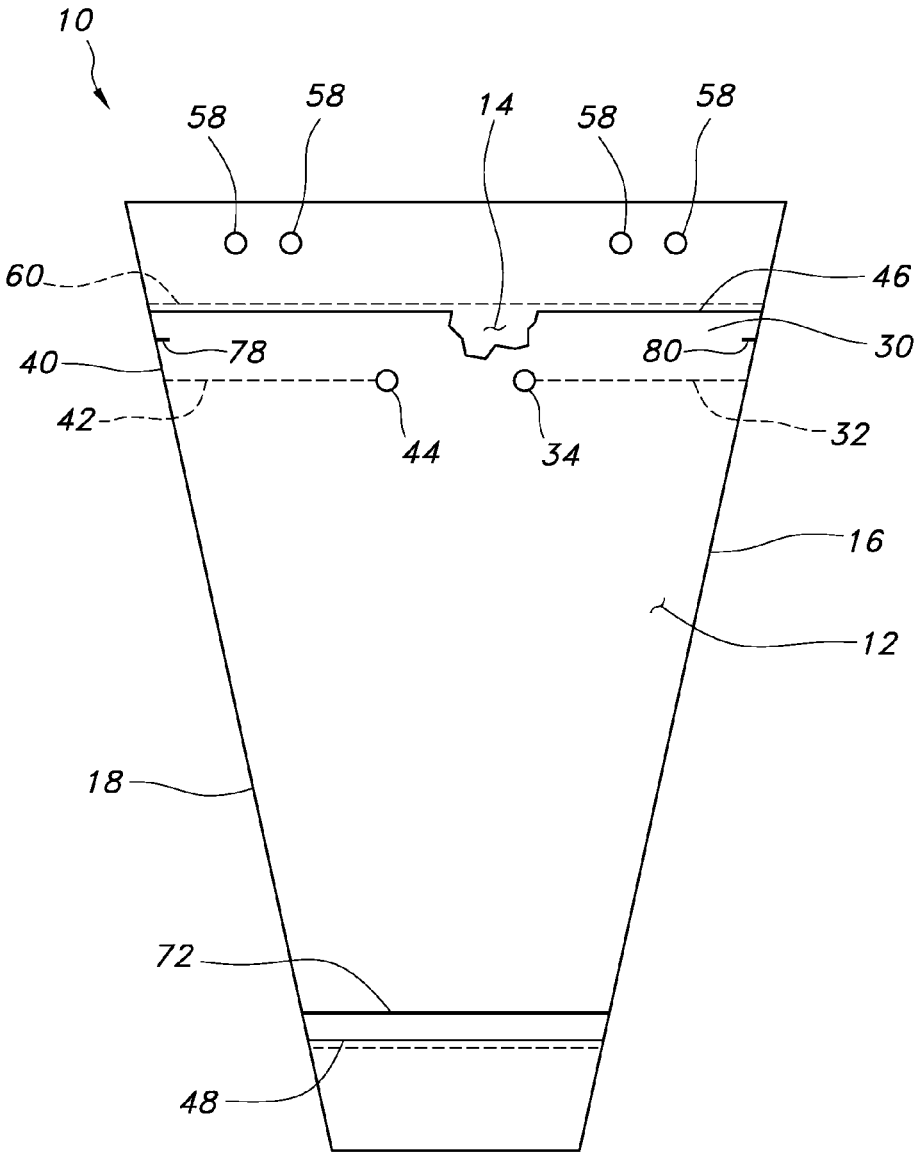
FIG. 2 is a front elevation view of the sleeve of FIG. 1 before it has been separated from a header and opened for use.

The sleeve 10 shown in FIG. 1 is suitable for holding a bouquet, produce, or other products or materials. The sleeve 10 is shown in an open condition, as it would be when holding a bouquet of flowers, for example, or another article. The sleeve 10 is formed from a front panel 12 and a rear panel 14 which are joined together to form first and second seams along first and second edges 16 and 18. The sleeve 10 is manufactured with the front and rear panels 12 and 14 flat against each other as shown in FIG. 2. In use, the panels 12 and 14 are separated from each other so as to enclose a space 20 (FIG. 1) for receiving an article such as a floral grouping. (An exemplary floral grouping is shown in phantom lines in FIG. 1.) The panels 12 and 14 can be tapered. If the panels 12 and 14 are tapered, the resulting enclosed space 20 is roughly frusto-conical in shape.

The sleeve 10 may be formed of suitable flexible thermoplastic material, including thermoplastic polyolefins such as polyethylene, polypropylene, polyethylene, and/or polystyrene, including the OPP, CPP, and KPP. The sleeve 10 may be also formed out of any other suitable flexible sheet material such as fabric (woven or non-woven, natural or synthetic) or paper. The material may be clear, translucent, or opaque. The sleeve 10 may have decorative images and/or advertising materials printed on it; it may have care instructions for the goods or produce for which the sleeve 10 is intended.

The sleeve 10 also includes a first handle 30. See FIG. 1. During manufacture the handle 30 is defined by a first line of perforations 32. See FIG. 2. The first line of perforations 32 starts at the first edge 16 and extends toward the second edge 18. The perforations extend through the first panel and the second panel from front to back, forming a tear line. The first handle 30 may be freed from the remainder of the sleeve 10 by tearing along the first line of perforations 32. The first line of perforations 32 has an internal end formed by a first hole 34. The first hole 34 servers to limit tearing along the first line of perforations 32. As tearing progresses from the first edge 16 toward the center of the sleeve 12 and reaches the hole 34, the smooth, continuous curve of the hole 34 reduces stress concentrations and so tends to stop the tearing. The hole 34 is shown as being circular, but it could also be oval or some other smoothly curved shape.

The sleeve 10 can also include a second handle 40. The second handle 40 is defined by a second line of perforations 42. The line of perforations 42 starts at the second edge 18 and extends toward the first edge 16. The perforations of the second line of perforations 42 extend through the first panel 12 and the second panel 14 forming a tear line. The second handle 40 may be freed from the remainder of the sleeve 10 by tearing along the second line of perforations 42. The second line of perforations 42 has an internal end formed by a second hole 44 which functions like the hole 34.

The first and second lines of perforations 32 and 42 are located an inch or two down from the top edge 46 of the front panel 12 and from the line of perforations 60 which defines the top edge of the rear panel 14. The first and second lines of perforations 32 and 42 can each be, for example, about 6 inches long on a sleeve that is 16 inches wide across the top. The first and second line of perforations 32 and 42 could be as much as 5 inches down from the top edge 46 of the front panel 12 and from the line of perforations 60 which defines the top edge of the rear panel 14. The exact spacing downward selected depends in the material of which the sleeve is made and the merchandise it is intended to carry so that it does not tear unnecessarily easily, as well as aesthetic considerations.

The first and second lines of perforations 32 and 42 may be parallel to the top edge 46 of the first panel as shown in FIG. 2. The handles 30 and 40 can form to loop handles when freed from the sleeve 10 by tearing along the lines of perforations 32 and 42 and lifted to the position shown in FIG. 1. The loop handles 30 and 40 can be folded upward, making a convenient way to carry the sleeve 10 and any object that may be in it. Alternatively, the two loop handles may also be tied to each other in, for example, a square knot, to close the top of the sleeve 10. The handles 30 and 40 may be printed with the same colors as the balance of the sleeve, or may be in contrasting colors for decorative or other design purposes.

Figure 3:
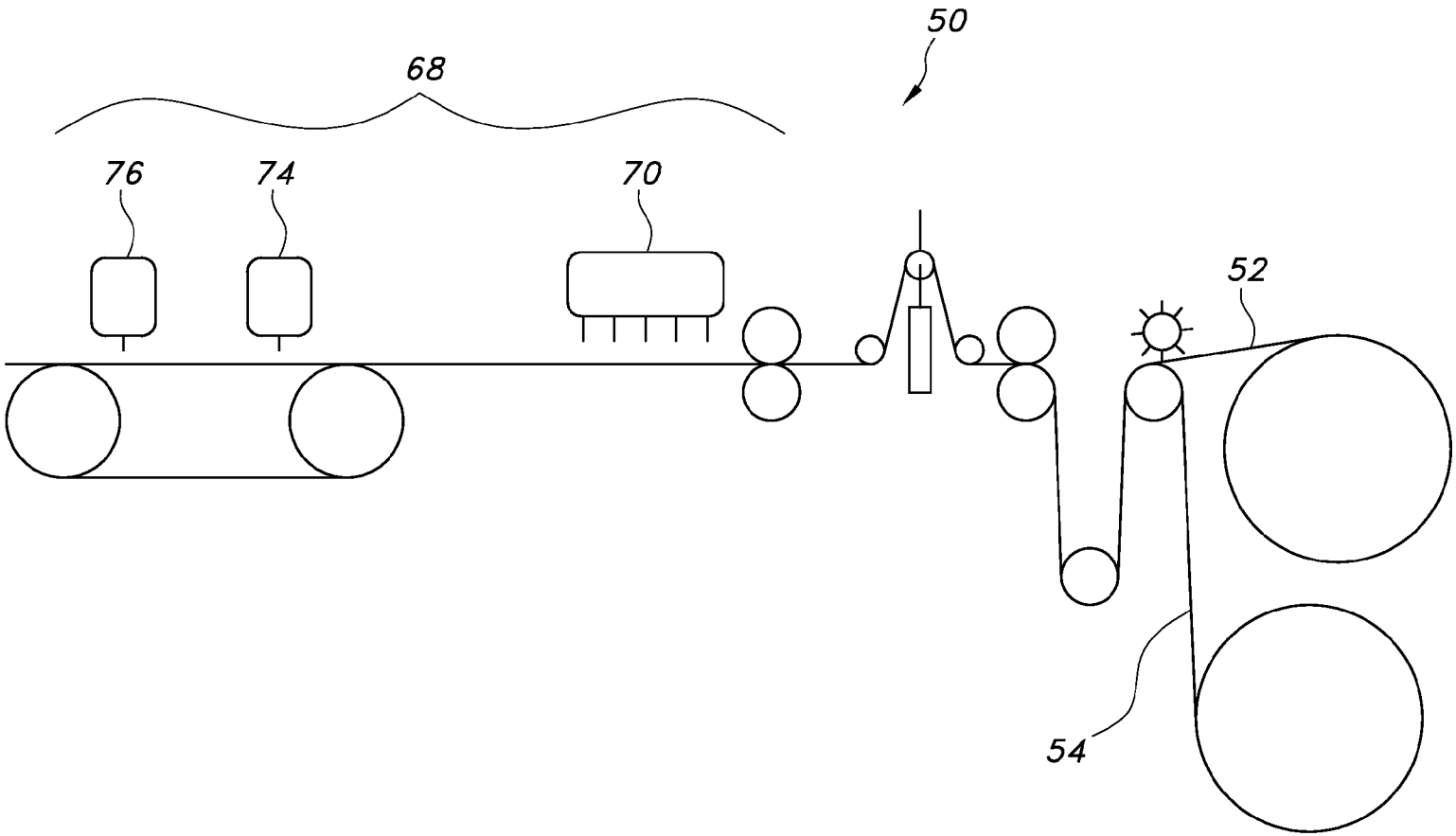
FIG. 3 is a schematic illustration of a machine for making sleeves following the teachings of this disclosure.
Figure 4:
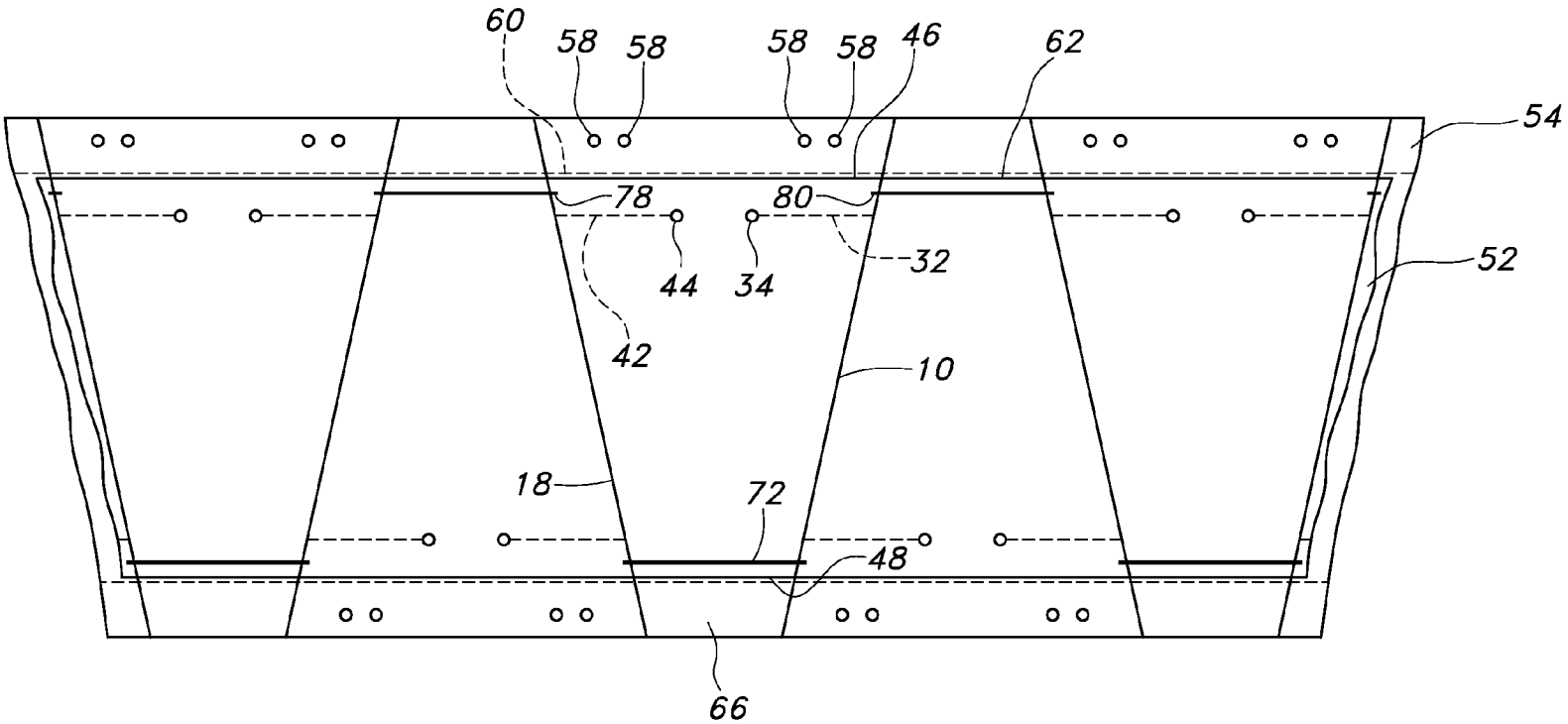
FIG. 4 shows a series of sleeves connected to each other in alternating orientations.

The sleeve 10 is made in a conventional sleeve making machine 50 shown schematically in FIG. 3. Suitable machines have been manufactured by LEMO Maschinenbau GmbH, Rheidter Strasse 52, 53859 Niederkassel-Mondorf, Germany. The sleeve making machine 50 may feed two webs, a top web 52 and a bottom web 54. The webs 52 and 54 are fed through the machine 50 which forms sleeves in alternating orientations as shown in FIG. 4. The words "top" and "bottom" are used in the context of the sleeve 10 shown in FIG. 2. Those skilled in the art will understand that alternate sleeves are manufactured upside down from this orientation. In FIG. 4 the various edges and perforations of only one sleeve are labeled, again with the understanding that the adjacent sleeves are oppositely oriented and have similar features.

The top web 52 (FIG. 4) forms the front panel 12 of the sleeve 10 and the bottom web 54 forms the rear panel 14. The top web 52 is the same width as the distance between the top and bottom edges 46 and 48, respectively of the front panel 12. The bottom web 54 forms the rear panel 14. The bottom web 54 is wider than the top web 52, and extends an equal distance above the top edge 46 of the top web 52 and the bottom edge 48 of the top web.

The difference in widths of the top and bottom webs 52 and 54 allows a header 56 to be formed at the top of the rear panel 14. The header 56 can include mounting holes 58 spaced to industry standards to accommodate a mounting device such as a wicket. A line of header-separating perforations 60 extends across the sleeve 10, allowing the sleeve to be separated from the header 56. The line of header-separating perforations 60 is located just above the edge of the 62 of the top web 52. The header-separating perforations 60 ultimately define the top edge of the rear panel 14 of the sleeve 10, while the top edge 62 of the top web 52 forms the top edge 46 of the sleeve 10.

As noted, the bottom web 54 extends beyond the bottom 48 of the top web 52. This leaves a flap of excess material 66 equal in width to the header 54. The position of the top web 52 with respect to the bottom web 54 allows a series of sleeves to be made in a side by side arrangement with the sleeves facing in alternating directions, as shown in FIG. 4.

The machine 50 (FIG. 3) includes a section 68 (called the "synch section") where the webs 52 and 54 are advanced intermittently, allowing various cutting and sealing operations to be performed while the webs are not moving. In this section a number of operations are performed on the webs. A bar with hot dies 70 can punch the mounting holes 58, and a bottom seal 72 can be formed. The bottom seal 72 can be formed with a bar (copper wire) sealer wrapped in Teflon. Likewise the first line of perforations 32 and second line of perforations 42 can be made either at the same station as the bottom seal or at an adjacent station in the synch section. After the cuts and seals that extend lengthwise of the webs 52 and 54 are formed, the first panel and second panel can be joined to each other along the first edge 16 and the second edge 18 by means of hot knives 74 and 76. The sleeves are then stacked into bundles that have a predetermined count and packaged for shipping.

Once the sleeves are bundled, they can be put to use, suspending the entire bundle near, for example, a retail display of produce or flowers. The sleeves are mounted with the first panel 12 facing out. The consumer then can grab the top edge 46 of the first panel 12 and open the sleeve, placing a bouquet or other merchandise inside. The entire sleeve 10 is then separated from the header 56 by tearing along the header-forming perforations 60, and the handles 30 and 40 can be separated from the first and second panels 12 and 14 by tearing along the first and second line of perforations 32 and 42. The sleeve then takes the configuration shown in FIG. 1, with the customer carrying the sleeve by the handles 40 and 42.

As shown in FIG. 4, the bottom seal 72 is located even with the handle forming portion of the adjacent sleeves. The bottom seal 72 is made slightly longer than the width of the bottom of the sleeve so that the seal extends into the handles of adjacent sleeves. The extensions 78 and 80 of bottom seal 72 (FIG. 2) thus form a reinforcement to the side seams to 16 and 18 and help assure that the handles 30 and 40 to not split apart.

Figure 5:
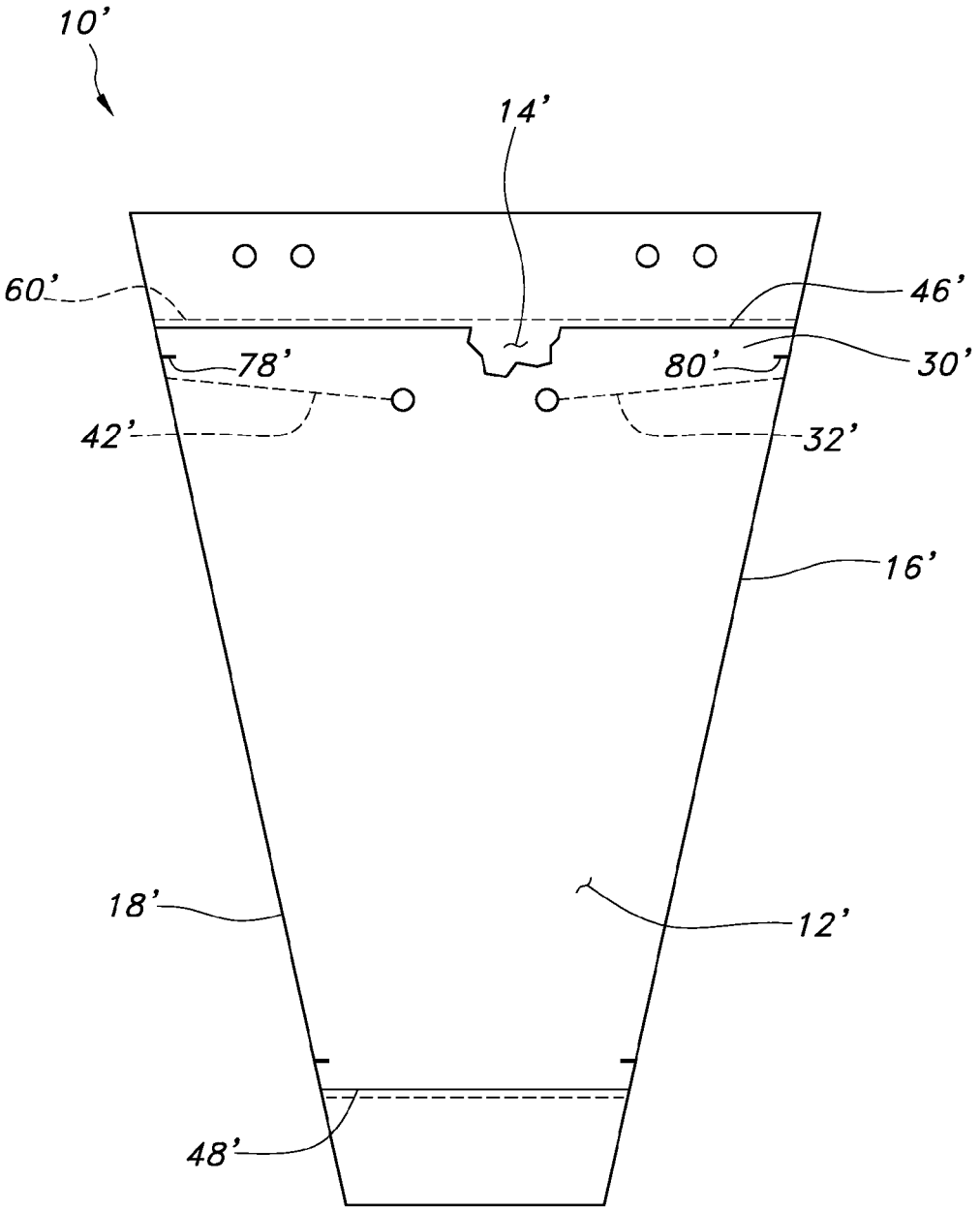
FIG. 5 is a front elevation view of the sleeve with handles that taper.

There are a number of variations in the sleeves made following the teachings of this disclosure. The sleeve 10 may be made with an open bottom. In that case the seal 72 may be omitted entirely. FIG. 5 illustrates other variations, and similar reference numerals with a prime (') are used to indicate the similar parts. As shown in FIG. 5, the sleeve 10' is formed with an open bottom and two short seals adjacent the side seams 16' and 18'. The two short seals produce the reinforcements 78 and 80, but do not seal the entire bottom of the sleeve, as shown in FIG. 5.

The second variation involves the orientation and configuration of the first and second lines of perforations 32 and 42. In FIG. 1, these are shown as being parallel to the top edges 46 of the front panel 12 and the header-separating perforations 60 in the rear panel 14. In FIG. 5, the first and second lines of perforations 32' and 42' are inclined with respect to the top edge 46' of the front panel 12' and the line of header-separating perforations 60 in the rear panel 14'. In addition, while the first and second lines of perforations 32' and 42' are shown as being straight, they could also be curved or sinuous in order to achieve a desired design effect. Thus a "line of perforations" need not be straight, but may have any desired contour.

Figure 6:
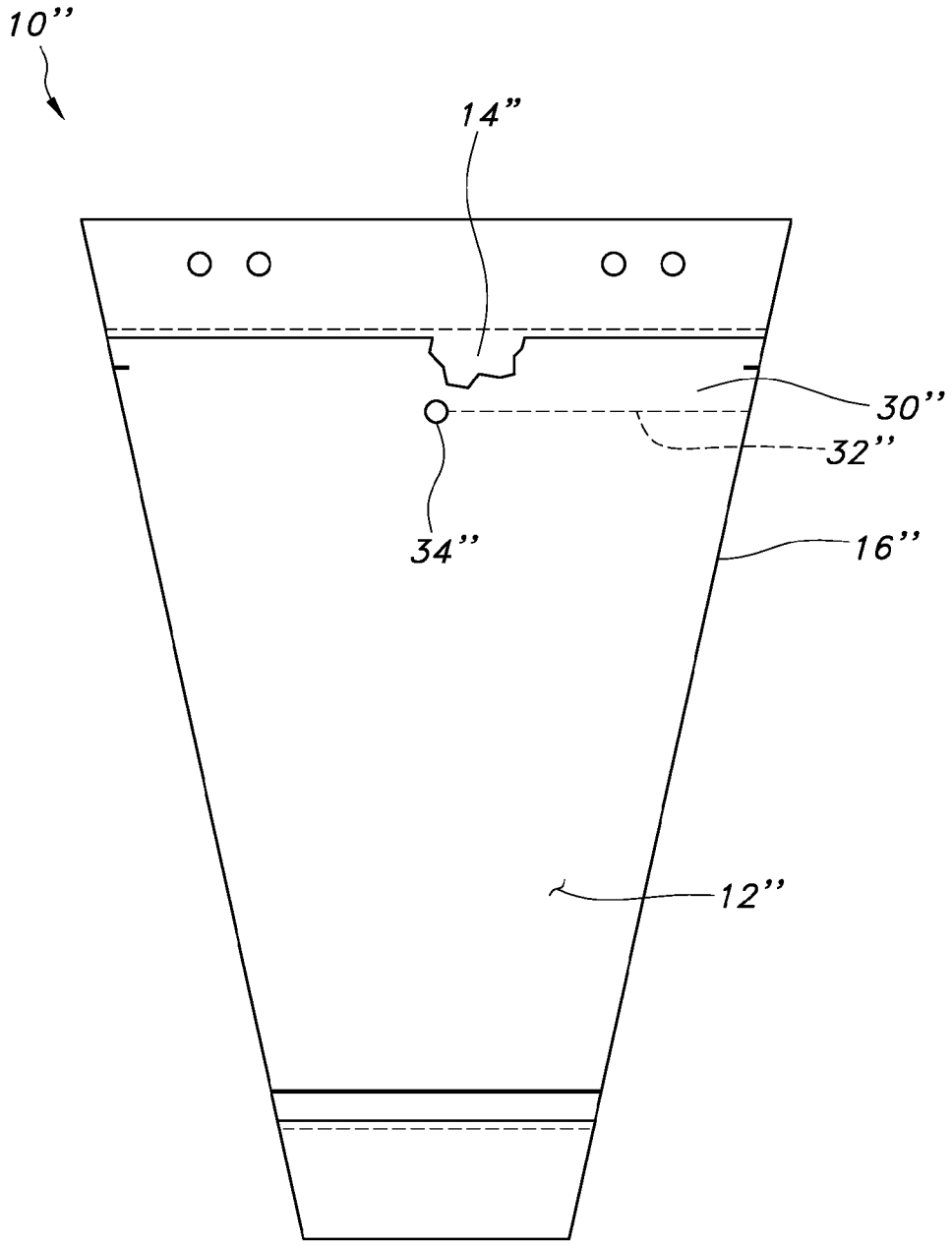
FIG. 6 is a front elevation view of a sleeve with a single handle.

A third variation is illustrated in FIG. 6. The sleeve 10" has only a single handle 30" which separates from the balance of the sleeve along a line 32" of perforations which extend from one side seam 16" approximately to the vertical centerline of the sleeve. A stress reducing hole 34" reduces the likelihood of tearing past the centerline. The line of perforations 32" may be parallel to the top edge 14" of the front panel 12" or inclined, and it may be straight or curved to give the desired shape to the top of the sleeve 10" and the handle 30".

While the inventive principles have been illustrated by the description of various embodiments thereof, and while the embodiments of been described in considerable detail, it is not intended to restrict or in any way limit the scope of the appended claims to such detail. Additional advantages and modifications will be readily apparent to those skilled in the art. The invention in its broader aspects is therefore not limited to the specific details, representative apparatus, methods and examples shown and described. Accordingly, departures may be made from such details without departing from the scope or spirit of the general inventive principles.

The invention claimed is:

1. A sleeve formed from two flat panels each having a top edge, a bottom edge, and two side edges, the side edges being spaced apart to define the width of the sleeve, the two panels being joined to each other along the opposite side edges to form a pair of seams, the sleeve including a first handle defined by a line of perforations through the two panels that extends from one of the two seams across part of the width of the two panels toward the other seam, the panels being separable from each other across their top edges to enclose a space into which an article such as a floral grouping may be placed, the sleeve including a second handle defined by a line of perforations extending from the other of the two seams toward the one seam, the first and second handles being separable from the first and second panels along their respective line of perforations and can be lifted upward to span the space between the top edges of the panels, and including a reinforcement formed by sealing the front and rear panels to each other at a location between the lines of perforations and the top of the panels inward of the side seams.

2. A plurality of sleeves as set forth in claim 1 manufactured in alternately opposite orientations wherein the reinforcement on one sleeve forms a continuation of the bottom seal of an adjacent sleeve.

* * * * *